US006609702B1

(12) United States Patent
Steffes

(10) Patent No.: US 6,609,702 B1
(45) Date of Patent: Aug. 26, 2003

(54) PICKET FENCE CAP ASSEMBLY

(76) Inventor: Stephen W. Steffes, 531 Oaklane, McPherson, KS (US) 67460

( * ) Notice: Subject to any disclaimer, the term of this patent is extended or adjusted under 35 U.S.C. 154(b) by 0 days.

(21) Appl. No.: 10/138,072

(22) Filed: May 2, 2002

Related U.S. Application Data

(63) Continuation-in-part of application No. 10/081,510, filed on Feb. 22, 2002.

(51) Int. Cl.[7] ..... E04H 17/14
(52) U.S. Cl. ..... 256/1; 256/65.01; 256/19
(58) Field of Search ..... 256/65.01, 66, 256/1, 19, 11, 12, 24

(56) References Cited

U.S. PATENT DOCUMENTS 5,645,270 A * 7/1997 Lawrence ..... 256/66
2002/0104985 A1 * 8/2002 Lesenskyj ..... 256/65.1
2002/0104986 A1 * 8/2002 Lesenskyj ..... 256/65.1

OTHER PUBLICATIONS

Picket Fence Cap and CLips Product Literature, 2001 LMT–Mercer Group, Lawrenceville, New Jersey.
Picket Fence Caps and CLips Product Literature, TopCaps, Pompano Beach, Florida.

* cited by examiner

*Primary Examiner*—Lynne H. Browne
*Assistant Examiner*—John Cottingham
(74) *Attorney, Agent, or Firm*—John F. Letchford; Klehr, Harrison, Harvey, Branzburg & Ellers LLP

(57) ABSTRACT

A clip-on picket fence cap assembly that can resist detachment of a plastic picket cap member from a plastic picket member when significant pulling force is applied to the cap member. The legs of the cap member upon which the clips are installed are very stiff by virtue of being reinforced by gussets that resist deflection of the legs when inserted in a picket. The assembly includes clips having outer surfaces that are substantially arched or bowed in shape in order to enhance their strength and resistance to deformation. The outer surface of each clip is preferably provided with at least one outwardly projecting retention means adapted for secure embedment into the inner wall surfaces of a picket member when the cap assembly is inserted therein.

26 Claims, 3 Drawing Sheets

PICKET FENCE CAP ASSEMBLY

CROSS-REFERENCE TO RELATED APPLICATION(S)

The present application is a continuation-in-part of copending U.S. patent application Ser. No. 10/081,510, filed Feb. 22, 2002, entitled PICKET FENCE CAP ASSEMBLY.

FIELD OF THE INVENTION

The present invention relates in general to fence structures and in particular to a picket fence structures.

BACKGROUND OF THE INVENTION

A wide variety of fencing structures have long been used to separate or enclose areas of industrial, commercial, residential and other properties. Common examples include stockade, chain link, wire, split rail and picket fencing. Fencing products may be fabricated from many different type of materials such as metal, wood, plastics and combinations or composites thereof. Among these, plastic and plastic-based fencing products are becoming increasingly popular. This is because they are relatively easy and inexpensive to manufacture and because consumers appreciate their attractiveness, low-maintenance, durability and competitive cost.

Plastic picket fencing represents a significant segment of the fencing industry. The pickets of a typical plastic picket fence are designed to resemble wooden pickets but are usually made from two pieces, the picket member and an upwardly pointed cap member that may be adhesively attached or mechanically fastened to the picket member. A disadvantage of using glue to attach the cap to the picket is that it can be messy and unsightly if applied improperly. Moreover, adhesives tend to become brittle and lose their bonding strength when exposed to the elements for extended periods of time. As such, after the passage of time it is not unusual for an adhesively attached cap to become relatively easily detachable from its picket. Such loosened caps can then become separated from their pickets by vandals or by something as benign as a strong wind, thereby leaving the fence in an incomplete, unsightly condition.

Mechanical fixation is an alternative to adhesive attachment of a plastic cap member to a plastic picket fence member. Mechanical fixation involves the creation of a friction or interference fit between the cap and picket members. Examples of picket fence cap assemblies that utilize such a friction fit principle are marketed by LMT Products Corporation ("LMT") of Lawrenceville, N.J. These assemblies comprise the cap member itself as well as a pair of stainless steel metal clips. The molded plastic cap member includes a plurality of downwardly depending legs that are adapted for insertion into the open top of a plastic picket. The picket is a typically a predetermined length of hollow extruded rigid polyvinyl chloride (PVC), polycarbonate, acrylic ester-modified styrene acrylonitrile terpolymer (ASA) or other plastic material having a rectangular cross sectional configuration designed to impart to the picket the shape of a wooden board or plank. Each of the metal clips includes a barb that functions to securely attach the clips to the cap member when the clips are press fitted onto the bottoms of legs disposed at opposite ends of the cap member. The clips include outwardly and upwardly inclined flat tabs or fingers that, when the cap member is inserted into the picket member, frictionally engage the inner surfaces of opposite end walls of the picket member. It is this frictional engagement of the clips with the picket member which serves to retain the cap member on the picket member.

As presently constructed, the LMT clip-on picket fence cap assemblies cap members can be extracted from their pickets by the exertion of about 8–15 lbs. tensile or pulling force. While this level of resistance is sufficient to prevent detachment of the cap member as a result of a strong wind, it would not be enough to deter a determined vandal.

An advantage exists, therefore, for a clip-on picket fence cap assembly that can resist detachment of a plastic picket cap member from a plastic picket member when significant pulling force is applied to the cap member.

SUMMARY OF THE INVENTION

The present invention provides a clip-on picket fence cap assembly that can resist detachment of a plastic picket cap member from a plastic picket member when significant pulling force is applied to the cap member. The assembly overcomes the deficiencies of existing products in several ways. First, the legs of the cap member upon which the clips are installed are very stiff by virtue of being reinforced by gussets that resist deflection of the legs when inserted in a picket. This is contrasted with conventional cap members whose unreinforced legs flex inwardly upon insertion into a picket, thereby inhibiting the metal tabs of the clips from "hooking" or "biting" into the inner walls of the extruded picket. Second, the metal clips that are fastened to the legs are substantially thicker and less easily deformed than presently available clips. Preferably, at least the outer surfaces of the clips are substantially arched or bowed in shape in order to enhance the strength of the clips and their resistance to deformation. In addition, the outer surface of each clip is preferably provided with at least one outwardly projecting retention means adapted for secure embedment into the inner wall surfaces of a picket member when the cap assembly is inserted therein. Preferably, the retention means is constructed as at least one barb. The resultant assembly is substantially stiffer and stronger than presently available clip-on picket fence cap assemblies. Because of this, its clips very firmly embed themselves into a picket and make it very difficult to extract the cap from the picket by simply pulling on the cap.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 3:
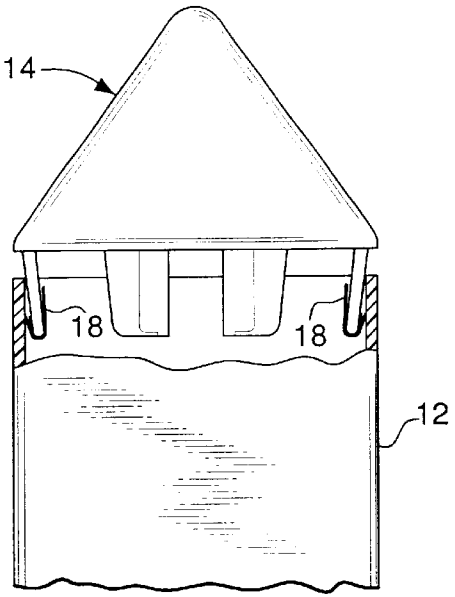
FIG. 3 is a partially broken, side elevation view of the assembly of FIG. 2 installed in a plastic picket.

Referring to the drawings, wherein like references indicate like or similar elements throughout the several views, there is shown a conventional plastic fence picket 10 in assembled condition. Picket 10 includes a hollow, typically extruded, plastic picket member 12 and a molded plastic cap member 14. The picket member 12 may be of any desired length and may be square or, more commonly, rectangular in cross-section. It may have outer width and thickness dimensions ranging from about 1½ to about 6 inches in width and from about ¾ to about 1½ inches in thickness. The base of the top or finial portion of the cap member 14 normally corresponds in size and shape to the outer width and thickness dimensions of the picket member 12. And, the top or finial portion of the cap member 14 may assume any desired configuration. For example, by way of illustration but not limitation, it may be formed as a complete (as illustrated) or truncated upwardly tapering pyramid such that, when the cap member 14 is inserted into the picket member 12, the resultant picket 10 simulates the shape of a conventional wooden picket. As stated previously, cap member 14 may be adhesively attached to or clipped onto the picket member 12.

Picket member 12 and cap member 14 may be formed entirely of plastic such as PVC, polycarbonate, ASA or other rugged plastics. Alternatively, they may be a composite of plastic and natural and/or artificial fibrous materials to enhance the strength and/or paintability of the products. As is known, the plastic may also include ingredients for promoting weather resistance, UV radiation resistance, mildew resistance, fading or discoloration resistance and/or for imparting other beneficial properties to the products.

Figure 2:
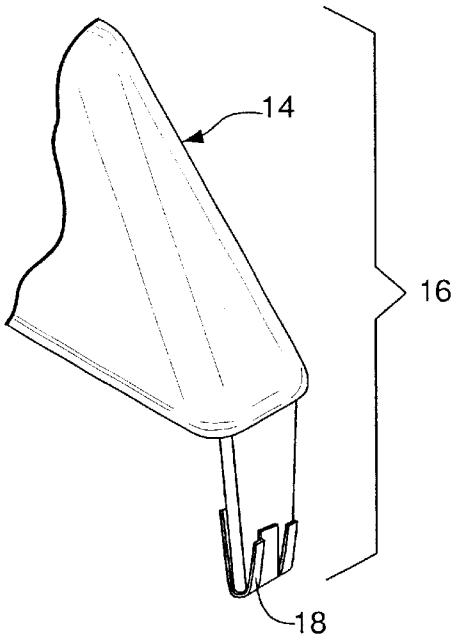
FIG. 2 is an isometric view of a clip-on picket fence cap assembly known in the art.
Figure 1:
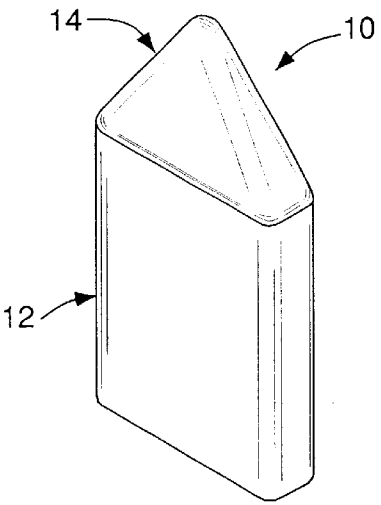
FIG. 1 is an isometric view of a plastic fence picket in assembled condition.

FIGS. 2 and 3 show the structural aspects of a conventional clip-on picket fence cap assembly 16 that is known in the art. Assembly 16 comprises a molded plastic cap member 14 that is affixable to an extruded plastic picket member 12 via a pair of metal clips 18. Clips 18 are typically fabricated from stainless steel or other corrosion-resistant metal or metal alloy. The cap member 14 includes a plurality of downwardly depending side legs 20 and end legs 22 that are adapted for insertion into the open top of picket member 12. Each clip 18 includes a substantially U-shaped central portion which is adapted to receive the bottom of a respective one of the end legs 22 disposed at opposite ends of cap member 14. Clips 18 are press fitted onto end legs 22 and each clip includes a barb (not illustrated) that functions to securely retain the clip on its associated cap member end leg 22. Clips 18 include outwardly and upwardly inclined flat tabs or fingers 26. As illustrated in FIG. 3, when the cap member 14 is inserted into the picket member 12, end legs 22 flex inwardly (the degree of flexure being exaggerated for emphasis) while tabs 26 frictionally engage the inner surfaces 28 of the opposite end walls 30 of the picket member 12 in order to retain the cap member on the picket member. At present, the cap member 14 of a clip-on type picket fence cap assembly constructed generally in accordance with that shown in FIGS. 2 and 3 can be extracted from picket member 12 with about 15 lbs. of pulling force or less.

Figure 4:
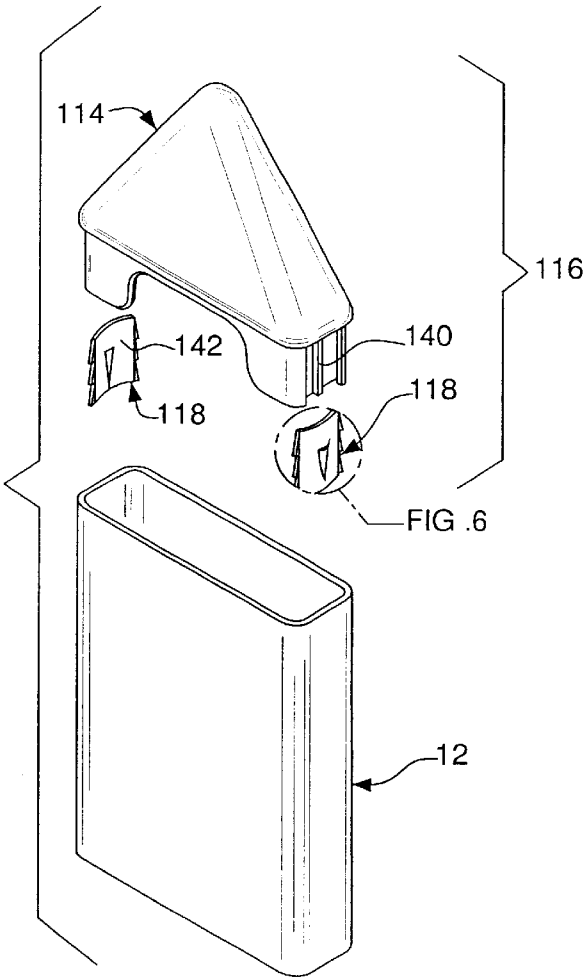
FIG. 4 is an exploded isometric view of a plastic picket and a clip-on picket fence cap assembly according to the present invention.

FIG. 4 is an exploded isometric view of a plastic picket 12 and a clip-on picket fence cap assembly 116 according to the present invention. Assembly 116 preferably comprises a molded plastic cap member 114 that is affixable to an extruded plastic picket member 12 via a pair of metal clips 118. Clips 118 are desirably fabricated from stainless steel or other corrosion-resistant metal or metal alloy.

Figure 7:
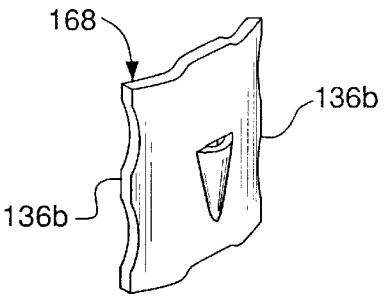
FIG. 7 is an enlarged view of a further embodiment of a clip of the clip-on picket fence cap assembly according to the present invention.
Figure 5:
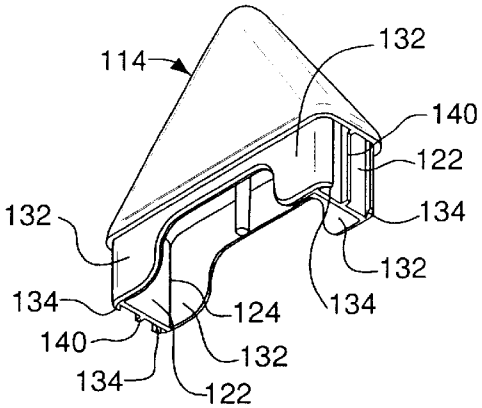
FIG. 5 is an isometric view of the cap member of the clip-on picket fence cap assembly according to the present invention.
Figure 6:
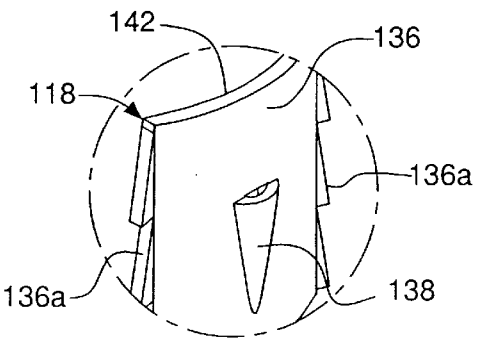
FIG. 6 is an enlarged view of a first embodiment of a clip of the clip-on picket fence cap assembly according to the present invention.

As perhaps most clearly depicted in FIG. 5, cap member 114 preferably includes a pair of end legs 122 that are adapted for insertion into the open top of picket member 12. Each end leg 122 is preferably stiffened to resist inward flexure by reinforcement means in the form of at least one or, as illustrated, a plurality of gusset plates 132. In the preferred embodiment, each end leg 122 is integrally connected at or near its opposed, substantially vertical edges 124 to a pair of gusset plates 132. At its outwardly facing side, i.e., the side thereof opposite the gusset plates 132, and located generally along vertical edges 124, each end leg 122 comprises a pair of opposed lips 134 that face one another to define substantially vertical grooves or slots for receiving the side edges of a clip 118, the physical details of which are most clearly shown in FIGS. 6 and 7.

The side edges of clips 118 include anchorage means such as saw-toothed or serrated barbs (reference numeral **136*a* in FIG. 6) or scalloped barbs (reference numeral 136*b* in FIG. 7) that are useful for embedding the clips 118 into the grooves formed by the opposed lips 134 once the clips are press-fitted into the grooves. According to the invention, at least the outer surfaces 136 of clips 118 (FIG. 6) and the outer surfaces 236 of clips 218 (FIGS. 8 and 9) are preferably substantially arched or bowed in shape to enhance the clips' strength and resistance to deformation. Pursuant to the embodiment of clip 118 shown in FIG. 6, outer surface 136 may be convex curvilinear in shape. The outer surface 136 of each clip 118 may directly contact the inner surface of an end wall of a picket member when the cap assembly 116 is inserted therein. However, it is preferred that the outer surface 136 of each clip be provided with at least one outwardly projecting retention means 138 for promoting secure embedment of the clip into the inner surface of an end wall of a picket member when the cap assembly 116 is inserted therein. According to a presently preferred embodiment, retention means is 138 constructed as at least one convex curvilinear barb that is stamped or formed from the material of the clip itself during formation thereof. Just as the arched or bow shape of the clip 118 stiffens the clip itself, the convex curvilinear shape of the retention means 138** acts to resist deformation of the retention means.

In addition, clips 118 are preferably substantially thicker and less easily deformed than presently available clips such as clips 18 of FIGS. 2 and 3. By way of comparison, clips 118 are preferably fabricated from 0.040 inch thick stainless steel versus clips 18 which are made from 0.025 inch thick stainless steel. As a further measure to resist deformation of clips 118, the outwardly facing surfaces of end legs 122 may optionally be formed with raised support formations 140 (FIGS. 4 and 5) adapted to contact the inner surfaces 142 of clips 118 or the inner surfaces 242 of clips 218, described below.

Figure 8:
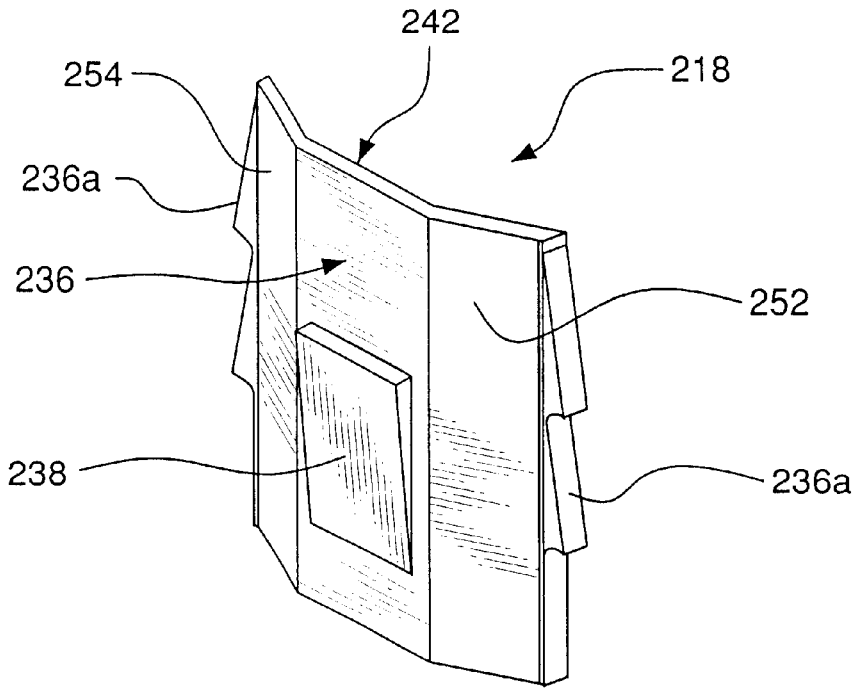
FIG. 8 is an enlarged view of a further embodiment of a clip of the clip-on picket fence cap assembly according to the present invention.
Figure 9:
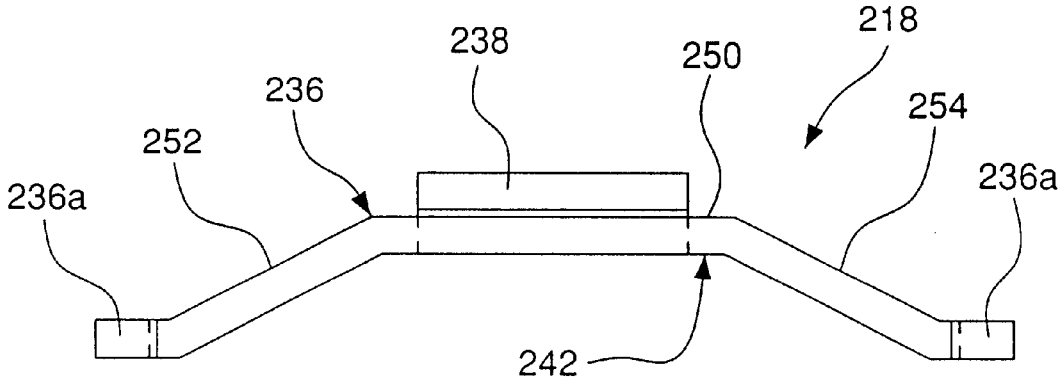
FIG. 9 is a top plan view of the clip of FIG. 8.

Referring to FIGS. 8 and 9, there is illustrated clip 218 according to a further embodiment of the invention which may be substituted for clip 118 of picket fence cap assembly 116. In the construction shown in FIGS. 8 and 9, the substantially arched or bowed shape of the outer surface 236 of clip 218 is achieved by forming or bending the clip to assume the shape of a segmented arch. More particularly, clip 218 may be formed from a plurality of contiguous portions arranged to create a generally arched shape. In the preferred embodiment, clip 218 comprises a central portion 250 bounded along its opposite edges by angled side portions 252,254. It will be understood that clip 218 may comprise as few as two or more than three contiguous portions so long as they together impart the desired substantially arched or bowed configuration to outer surface 236. And, the several contiguous portions of clip 218 may comprise a series of flat portions, as shown, curved portions or combinations of flat and curved portions.

Like clips 118, the side edges of clips 218 include anchorage means such as saw-toothed or serrated or scalloped barbs 236*a* that are useful for embedding the clips 218 into the grooves formed by the opposed lips 134 of cap member 114 once the clips are press-fitted into the grooves formed by lips 134. Similarly, it is preferred that the outer surface 236 of each clip be provided with at least one outwardly projecting retention means 238 for promoting secure embedment of the clip into the inner surface of an end wall of a picket member when the cap assembly 116 is inserted therein. According to a presently preferred embodiment, retention means 238 is preferably constructed as at least one barb that is stamped or formed from the material of the clip itself during formation thereof. The barb 238 may be flat, as illustrated in FIG. 8, or convex curvilinear in the manner of barb 138 of clip 118 of FIG. 6.

From the foregoing, it will be appreciated that the resultant picket fence cap assembly 116 of the present invention is substantially stiffer and stronger than clip-on picket fence cap assembly 16 of FIGS. 2 and 3. Because of this, clips 118 (or clips 218 if substituted for clips 118) very firmly embed themselves into a picket and make it very difficult to extract the cap member 114 from the picket member 12 by simply pulling on the cap member. Indeed, for conventional plastic pickets, the present inventor has observed that, for a cap member 114 and picket member 12 each having mating outer thickness and width dimensions of ⅞ inch and 3 inches, respectively, an average of about 29.5 lbs. of tensile force is required to extract the cap member 114 of assembly 116 from the picket member 12, which serves as a meaningful deterrent to someone seeking to remove the cap member from the picket member.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A cap assembly for a hollow plastic fence picket member, said assembly comprising:

a plastic cap member including a top portion and a pair of end legs downwardly depending from said top portion and adapted for insertion into the picket member; and a pair of clips each having an inner surface and a substantially convex outer surface, wherein each respective one of said pair of clips is carried by a respective one of said pair of end legs and is adapted to contact an inner surface of an end wall of a plastic fence picket when the cap assembly is inserted therein.

2. The cap assembly of claim 1 wherein said clips are fabricated from metal.

3. The cap assembly of claim 1 wherein said cap member comprises means for resisting inward flexure of said end legs.

4. The cap assembly of claim 3 wherein said means for resisting inward flexure of said end legs comprise at least one gusset plate.

5. The cap assembly of claim 1 wherein each of said end legs comprise a pair of opposed lips that face one another to define grooves for receiving side edges of a respective one of said pair of clips.

6. The cap assembly of claim 5 wherein said side edges of said clips include anchorage means for embedding the clips into said grooves.

7. The cap assembly of claim 1 wherein each said end leg comprises a support formation adapted to contact a rear surface of a respective one of said clips.

8. The cap assembly of claim 1 wherein said outer surface of each of said clips is provided with at least one outwardly projecting retention means adapted for secure embedment into an inner surface of an end wall of a picket member when said cap assembly is inserted therein.

9. The cap assembly of claim 1 wherein said substantially convex outer surface of said clips is defined by a plurality of contiguous portions.

10. The cap assembly of claim 9 wherein said plurality of contiguous portions comprise three contiguous portions.

11. A plastic fence picket comprising:

a hollow plastic fence picket member; and a cap assembly for said picket member comprising:

a plastic cap member including a top portion and a pair of end legs downwardly depending from said top portion and adapted for insertion into said picket member; and a pair of clips each having an inner surface and a substantially convex outer surface, wherein each respective one of said pair of clips is carried by a respective one of said pair of end legs and is adapted to contact an inner surface of an end wall of said picket member when said cap assembly is inserted therein.

12. The picket of claim 11 wherein said clips are fabricated from metal.

13. The picket of claim 11 wherein said cap member comprises means for resisting inward flexure of said end legs.

14. The picket of claim 13 wherein said means for resisting inward flexure of said end legs comprise at least one gusset plate.

15. The picket of claim 11 wherein each of said end legs comprise a pair of opposed lips that face one another to define grooves for receiving side edges of a respective one of said pair of clips.

16. The picket of claim 15 wherein said side edges of said clips include anchorage means for embedding the clips into said grooves.

17. The picket of claim 11 wherein each said end leg comprises a support formation adapted to contact a rear surface of a respective one of said clips.

18. The picket of claim 11 wherein said outer surface of each of said clips is provided with at least one outwardly projecting retention means adapted for secure embedment into an inner surface of an end wall of a picket member when said cap assembly is inserted therein.

19. The picket of claim 11 wherein said substantially convex outer surface of said clips is defined by a plurality of contiguous portions.

20. The picket of claim 19 wherein said plurality of contiguous portions comprise three contiguous portions.

21. In a cap assembly for a hollow plastic fence picket member, the assembly comprising a plastic cap member including a top portion and a pair of end legs downwardly depending from said top portion and adapted for insertion into the picket member, a clip adapted to be carried by one of said pair of end legs and comprising:

an inner surface; and a substantially convex outer surface adapted to contact an inner surface of an end wall of a plastic fence picket when the end legs are inserted therein.

22. The clip of claim 21 wherein said clip is fabricated from metal.

23. The clip of claim 21 further comprising anchorage means for embedding said clip into one of the end legs.

24. The clip of claim 21 wherein said outer surface of said clip is provided with at least one outwardly projecting retention means adapted for secure embedment into an inner surface of an end wall of a picket member when the end legs are inserted therein.

25. The clip of claim 21 wherein said substantially convex outer surface of said clip is defined by a plurality of contiguous portions.

26. The clip of claim 25 wherein said plurality of contiguous portions comprise three contiguous portions.

* * * * *